United States Patent [19]

Albers

[11] 3,992,022

[45] Nov. 16, 1976

[54] DEVICE FOR TEACHING SKIING

[76] Inventor: Frederic L. Albers, 35 A Christie St., Ste. Anne DeBellevue, Quebec, Canada

[22] Filed: June 6, 1975

[21] Appl. No.: 584,590

[52] U.S. Cl. ..... 280/11.37 E; 35/29 R

[51] Int. Cl.[2] ..... A63C 11/00

[58] Field of Search..... 280/11.37 E, 11.13 T, 280/11.13 R, 11.37 R, 601; 35/29 R; 272/57 B

[56] References Cited

UNITED STATES PATENTS

| | | | |
|---|---|---|---|
| 3,295,860 | 1/1967 | VonHoven | 280/11.13 T |
| 3,357,714 | 12/1967 | Kuehn | 280/11.37 E |
| 3,567,239 | 3/1971 | Kitterman | 280/11.37 E |
| 3,703,299 | 11/1972 | Kutchma | 280/11.37 E |
| 3,751,056 | 8/1973 | Wightman | 280/11.37 E |

*Primary Examiner*—M. H. Wood, Jr.
*Assistant Examiner*—David M. Mitchell
*Attorney, Agent, or Firm*—Irving Kayton

[57] ABSTRACT

An instructional aid for holding the tips of a pair of skis together is disclosed. This aid is suitable for a novice skier learning to ski. It enables the skier to keep the skis in a snowplow position. The aid has a first and second clamping means adapted to be mounted on the tips of a pair of skis. One of the clamping means has a U-bend with a shank portion which extends downwards and hooks into an eyelet on a second clamping means attached to the tip of the other ski. The shank may easily be disengaged from the eyelet by the skier but not when the skis are in the snowplow position. Thus the skier need not remove the skis to separate the connection.

8 Claims, 5 Drawing Figures

DEVICE FOR TEACHING SKIING

THE INVENTIVE IMPROVEMENT

The present invention relates to an aid to teaching skiing to beginners. More particularly, the invention relates to a device for holding the tips of skis together when learning to ski on snow slopes.

One of the first positions of skiing taught to a beginner on a snow slope is the snowplow. In this position the skier must keep the tips of his skis together while spreading out the rear of the skis to form an approximate V with the tip of the V pointing down the slope. The skier then bends his knees forward and slightly inward causing the skis to ride on their inside edges, thus digging into the snow on the slope. This is referred to as edging and by varying the amount of edging the skier can control the speed down the slope. When beginners have learned the snowplow position and how to control their speed down the slope, then they can process on to more advanced positions and types of skiing.

It is common for a beginner when he first attempts to place the skis in the snowplow position to have little or no control over the tips of the skis and they invariably separate, cross or run one ahead of the other, sometimes causing the beginner to fall.

Ski patrol system statistics, as reported by the Snow Eagle Ski School in St. Jovite, Quebec, Canada, show that a majority of beginner accidents occur when the skis diverge. This causes a forward fall that often results in a fracture or knee sprain. Used of the device in accordance with the invention virtually eliminates the possibility of the forward fall. During the past ski season, the device of the invention has been used extensively for beginner instruction at the Snow Eagle Ski School in Canada from where it is reported that there has been not a single injury to beginning skiers using the device of the invention. Moreover, it is reported that instruction time to advance the student to the next level of proficiency, the elementary Christie, has been reduced from 50% to 90% and the ski-school dropout rate has been reduced virtually to zero.

The significant advantages of the invention thus described may readily be understood by an appreciation of the kinds of muscular effort necessarily expended by the beginning skier when attempting the snow-plow technique. His leg and thigh muscles must simultaneously be used to widen and narrow the edged orientation of the skis to brake and increase the speed of his downhill movement while rigidly maintaining the tips of the skis together as the vertex of the V angle. The energy needed to maintain the ski tips in a vertex is eliminated by the invention. Thus the student need only concentrate upon widening and narrowing the V. After his muscles are developed and he has become proficient at edging, he may readily perform the complete operation without the device of the invention. Since much fatigue is eliminated by the device of the invention, the learning process is not only more rapid but also more effective and enjoyable.

THE PRIOR ART

Various ideas have been attempted to link the tips of the skis together. These devices include an elastic strap as shown in U.S. Pat. No. 3,703,299 to Kutchma, and rods or bars as shown in U.S. Pat. No. 3,751,056 to Wightman and U.S. Pat. No. 3,357,714 to Kuehn. However, none of these devices has the advantage of being able to assemble or remove the connection by simply moving the tip of one ski relative to the other. Thus in the past it has been necessary for the instructor to disconnect the device joining the tips of the skis together, for the skier to bend down to disconnect the device, or in some cases the student has to take off the skis in order to disconnect the device. This improvement is of particular benefit to the skier who goes up a hill on a ski tow with the tips of the skis not connected together, then assembles the link by moving the tip of one ski relative to the other prior to skiing down the hill. In U.S. Pat. No. 3,567,239 to Kitterman, the device requires the insertion of the tip of a ski pole into a hole to join the tips together. such an arrangement, requiring a beginning skier to hold his pole rigidly in front of him while descending a slope is both unsafe and requires a body position incompatible with good ski technique.

SUMMARY OF THE INVENTION

It is therefore an object of the present invention to provide a device for joining together the tips of a pair of skis, the device being easily connected and disconnected by simply moving one ski relative to the other.

It is a further object of the present invention to provide a quick releasable connection for joining the tips of a pair of skis together, the connection having a pivoting movement, a vertical movement and an angular movement to allow the skis to be edged.

With these and other objects in mind, there is provided an instructional aid for holding the tips of a pair of skis together to enable a novice skier to keep the skis in a snowplow position with minimum effort. The aid comprises first and second clamping means adapted to be mounted to the tips of a pair of skis. A first connecting portion attaches to the first clamping means on one ski and extends toward the second clamping means on the second ski; the first connecting portion has a hook with a bend at the top and an open shank which extends downwardly. A second connecting portion is attached to the second connecting means and extends toward the first clamping means. The second connecting means has an eyelet with an aperture in a substantially horizontal plane thereby intercepting the downwardly extending shank of the first connecting portion. The aperture of the eyelet has a somewhat larger diameter than that of the cross-section of the shank. The shank of the first connecting portion is adapted to releasably connect the eyelet of the second connecting portion and provide for vertical, rotational and a small amount of transverse movement between the two connecting portions translatable to the skis.

With the foregoing more important objects and features in view and such other objects and features as may become apparent as this specification proceeds, the invention will be understood from the following description of a preferred form thereof taken in conjunction with the accompanying drawings which illustrate an embodiment of the invention.

DRAWINGS

DETAILED DESCRIPTION

Figure 1:
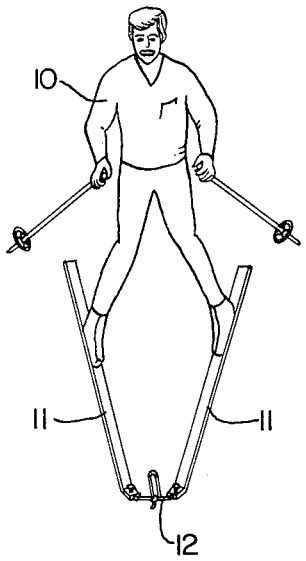
FIG. 1 is a front view of a skier in the snowplow position with an embodiment of the present invention attached to the tips of the skis.
Figure 2:
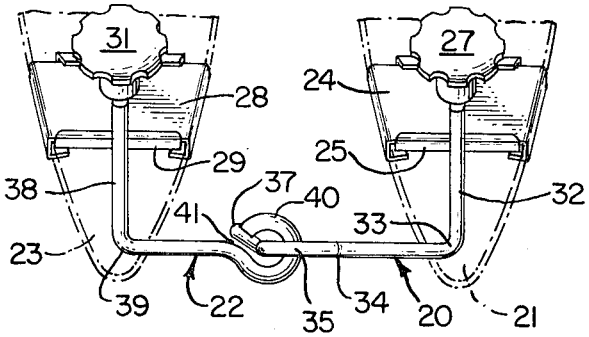
FIG. 2 is a plan view of one embodiment of the device of the present invention, showing the position of the tips of the skis in broken lines.
Figure 3:
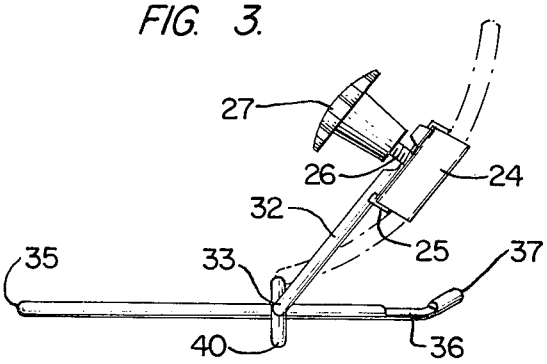
FIG. 3 is a side elevational view of the device shown in FIG. 2.

Referring now to the drawings, FIG. 1 shows a novice skier 10 having a pair of skis 11 joined at the tips by means of an instructional aid 12 of the present invention. The novice skier 10 has the skis 11 in the snowplow position and the instructional aid 12 holds the tips of the skis a predetermined distance apart, but allows the angle of the snowplow to vary, allows the tips to vary in elevation one with the other, and allows the skier to vary the angle of edging to control the speed down a slope.

The instructional aid shown in FIGS. 2, 3, 4 and 5 is formed of a first connecting portion 20 attached to the tip of a left hand ski 21 when looked at by a skier and a second connecting portion 22 attached to the tip of a right hand ski 23. The first connecting portion 20 has a shaped clamp 24 made from a suitable metal such as steel, and coated in such a manner so that rust does not pervade through to the metal. The coating may be galvanizing, enamelling, or alternatively, the shaped clamp 24 may be formed from stainless steel. This shaped clamp 24 is formed to fit on to the tip of a ski 21 and is held to the ski by means of a floater plate 25 which has flanges extending on each side of the shaped clamp 24 and is pushed down to the shaped clamp 24 by means of a pressure screw 26 having an octagonal cap 27 with concave faces at each side. The octagonal cap 27 preferably has a diameter of approximately 1½ inches and is preferably raised above the shaped clamp 24 by approximately 1 inch. The cap 27 may be tightened down to hold the shaped clamp 24 firmly on the tip of the ski 21.

On the right hand ski 23 is a shaped clamp 28 similar to the shaped clamp 24 on the left hand ski 21. The shaped clamp 28 has a floater plate 29 which is compressed upon the tip of the ski 23 by means of a pressure screw 30 having an octagonal cap 31 similar to the octagonal cap 27 on the left hand ski 21.

Extending from the shaped clamp 24 toward the tip of the left hand ski 21 is a rod 32 which after preferably approximately 2 inches has a right angle bend 33 so that the rod 32 extends inwardly toward the right hand ski 23. The rod 32 extends again for preferably approximately 2 inches as a connecting means and then has a further right angle bend 34 which projects the rod to extend substantially vertically. This vertical direction is achieved even though the slope of the ski at the location of the shaped clamp 24 places the first part of rod 32 in other than a horizontal orientation. Beyond bend 34 the rod 32 extends vertically preferably approximately 1½ inches and then has a U-bend 35 in the direction of the adjacent ski 23, with the rod then extending vertically downward, parallel to the previous section which extended upward, to form a shank. The shank of the rod 32 extending vertically downward is preferably approximately 3½ inches long and preferably has a pinched section 36 with two flattened parallel surfaces extending approximately 1 inch along the descending shank of the rod 32 directly above an offset bend 37 extending approximately three-fourth inch long to form the bottom end of the shank. This extension is at an angle of approximately 110° relative to the descending shank of the rod 32 and is also at approximately 30° angle to the first portion of the rod 32 extending from the shaped clamp 24. The rod 32 is preferably formed from one-fourth inch round material and preferably steel coated by paint, galvanizing or some other protection from rust. The pinched section 36 narrows the one-fourth inch diameter of the rod down to approximately one-eighth inch at its narrowest position. The angle of the pinched surfaces is preferably approximately 45 degrees relative to the first portion of the rod 32 extending from the shaped clamp 24.

From the second shaped clamp 28 on the right hand ski 23, a rod 38 extends forward preferably approximately 2 inches and then has a right angle bend 39 so that the rod 38 extends inwardly toward the left hand ski 21. The rod 38 as a connecting means extends for preferably approximately 2 inches and then ends in an eyelet 40 which has an internal diameter of preferably approximately three-fourth inch. This eyelet 40 does not completely close, but has a gap 41, preferably slightly less than one-fourth inch, to allow the pinched section 36 of the rod 32 to pass there between. The gap 41 in the eyelet is preferably at an angle of approximately 45° to the extended portion of the rod 38 from the shaped clamp 28.

In operation of the instructional aid, it will be seen that a novice or beginner may easily attach the clamping devices onto the tips of the skis. Alternatively, the skier may have the clamping devices placed on the skis in a ski shop before commencing a ski lesson. The aids are clamped in position by tightening the pressure screws 26 and 30 by means of the octagonal caps 27 and 31. The floater plates 25 and 29 press down on the top surface of the ski but do not damage the skis as the load is spread across the top of the ski and the flanges of the clamping devices rest on the ski's reinforced edges. To join the two portions of the aid together, it is necessary for the skier to pass the pinched section 36 of the rod 32 attached to the shaped clamp 24 through the gap 41 in the eyelet 40 at the end of the rod 38 attached to the shaped clamp 28. Once the pinched section 36 has passed through the gap 41, the left hand ski 21 may be lowered so the skis become level, the eyelet 40 moves up the portion of the shank of rod 32 and the two skis 21 and 23 are firmly albeit movably connected together and cannot be parted except by reciprocating the joining process. As the eyelet is larger in diameter than the shank, the skis may be tilted without restriction to a sufficient angle to allow the skier to edge his skis. Furthermore, in view of the up and down movement in the vertical plane, any variation in ground surface beneath the skis is taken into account by the eyelet 40 moving up and down the shank of rod 32. To disconnect the skis it is necessary to place them in parallel position and then raise the left ski 21 until it is possible to pass the pinched section 36 through the gap 41 in the eyelet 40. Because of the angle of the pinched section 36, the skis will remain attached as long as the skis are in snowplow position irrespective of the skis' relative elevation to each other. Thus the skis do not separate during a run down a ski slope.

Figure 5:
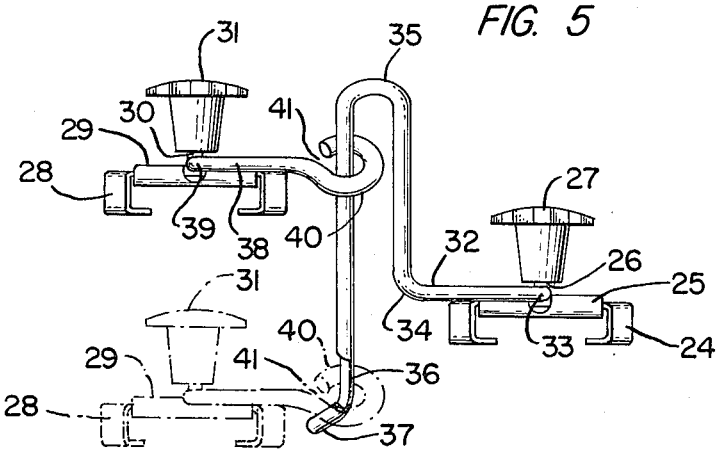
FIG. 5 is a front elevational view of the device shown in FIG. 2, showing the variation in height between the left and right clamp means, the lower position of the left clamp means being shown in broken lines.

The vertical movement of the right hand ski relative to the left hand ski is shown in FIG. 5. The lower chain dotted shaped clamp 28 indicates the position of the ski tip when the pinched section 36 of the shank of rod 32 enters the gap 41 in the eyelet 40. The other representation in FIG. 5 shows the shaped clamp 28 in its uppermost position relative to the other portion of the aid.

Figure 4:
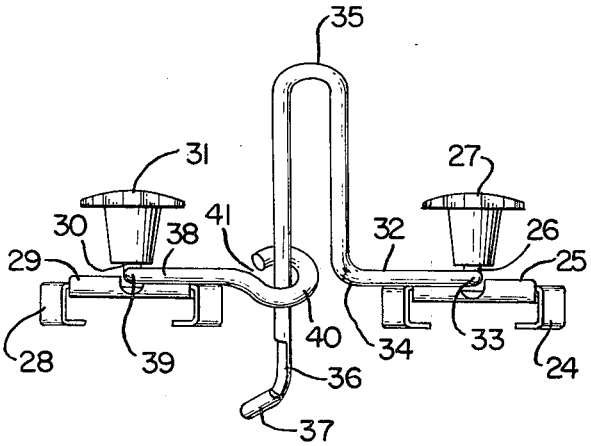
FIG. 4 is a front elevational view of the device shown in FIG. 2.

The angled length 37 forming the shank's end portion has the function of resisting, but not completely preventing, the shank exiting from the eyelet 40 when the left ski is elevated radically as when the left ski is over a rise in the snow and the right ski is in a valley. Consequently it may be seen that a shank with a straight rather than angled portion 37 would be operative although perhaps less desirable than the embodiment shown. It is desirable to have the pinch 36 toward the bottom of the shaft as shown in the diagrams. This minimizes chances of the shaft disengaging from the eyelet while the skier descends the slope whether in a snowplow or in parallel position. This is ensured because during descent of the slope the average position of the pinch 36 in relation to the gap 41 is as shown in FIG. 4, i.e., they do not align with one another. It is particularly important to ensure that the angle the flattened portion of pinch 36 makes with the gap 41 is such that the pinch of the shank may exit the gap only when the skis are parallel and not when they are in a snowplow orientation.

Various alterations may be made to the assembly shown and described herein without departing from the spirit and scope of the present invention. For instance, the pressure screws 26 and 30 need not have an octagonal cap thereon but may be replaced by a butterfly head or some other simple hand gripping device of tightening the pressure screw. Similarly, the dimensions disclosed and mentioned herein need not be strictly adhered to, these are only preferred. In some instances it may be preferable to have the pivot point, that is to say where the shank passes through the eyelet, at a greater distance from each ski so that the skis themselves are kept at a greater distance apart. In another embodiment, the shaped clamps are omitted and the rods are permanently attached to the tips of the skis, such skis would be specifically for teaching beginners how to ski.

The invention in which an exclusive property or privilege is claimed is:

1. A device for helping to maintain a pair of skis in snowplow orientation, comprising:

a. a first means adapted for rigid connection to a first ski and having a shank portion which extends substantially vertically when said first means is connected to the front tip of said first ski and said first ski is on a horizontal surface;

b. a second means adapted for rigid connection to a second ski and having an eyelet portion the plane of which extends substantially horizontally when said second means is connected to the front tip of said second ski and said second ski is on a horizontal surface; and (c) wherein said shank and eyelet are offset in from said first and second means, respectively, a direction toward each other and transverse to said skis when said first and second means are connected to said first and second skis, respectively.

2. A device for helping to maintain a pair of skis in snowplow orientation as recited in claim 1, including means formed by a portion of said shank and a gap in said eyelet for permitting engagement of said shank with said eyelet through transverse motion of said skis relative to each other when said skis are parallel and for preventing disengagement through transverse motion of said skis relative to each other when said skis are in a snowplow orientation.

3. An instructional aid for holding the tips of a pair of skis together to enable a novice skier to keep the skis in a snowplow position, comprising:

a. first and second clamping means adapted to be mounted to the tips of a pair of skis;

b. a first connecting portion rigidly attached to said first clamping means and extending toward said second clamping means when said clamping means are mounted on skis;

c. said first connecting portion having a U-bend at the top and a shank extending substantially vertically downward;

d. a second connecting portion rigidly attached to said second clamping means and extending toward said first clamping means when said clamping means are mounted on skis;

e. said second connecting portion having an eyelet with an aperture oriented to receive said downwardly extending shank of said first connecting portion;

f. said aperture being slightly larger than the transverse cross-sectional size of said shank;

g. and means formed by a portion of said shank and a portion of said eyelet for engagement and disengagement of said shank and eyelet with each other when said skis are parallel to each other and for preventing disengagement when said skis are in a snow-plow orientation.

4. The instructional aid of claim 3 wherein the lower portion of said shank has an offset bend therein.

5. The instructional aid of claim 3 wherein said shank of said first connecting portion has a pinched section therein and said eyelet of said second connecting portion has a gap therein, said pinched section of said shank being proportioned thinly enough to pass through said gap in said eyelet and angled relative to the angular orientation of said gap to permit said passage only when said skis are parallel to each other.

6. The instructional aid of claim 3 wherein said first and second clamping means are detachably connected to the tips of a pair of skis.

7. The instructional aid of claim 3 wherein said clamping means each comprises a shaped clamp with flanged shoulders adapted to fit over the tip of said ski, a floater plate fitted inside said clamp and a pressure screw with finger grips adapted to clamp said floater plate and shaped clamp to the tip of said ski.

8. The instructional aid of claim 5 wherein said pinched section is located closer to the lower end of said shank than toward the top U-bend end of said shank so that said pinched section of said shank is closer to the ground than said eyelet when said eyelet and shank are engaged and said skis are both on the same flat surface.

* * * * *